US006125472A

United States Patent [19]

Nakagawa

[11] Patent Number: 6,125,472

[45] Date of Patent: Oct. 3, 2000

[54] VENTILATIVE AND/OR DECORATIVE CLOTHING, HEADGEAR, OR SACKS AND BAGS

[75] Inventor: Yoshimitsu Nakagawa, La 62, Kurumi-cho, Komatsu-shi, Ishikawa-ken, Japan

[73] Assignees: Yoshimitsu Nakagawa, Ishikawa-ken; Leaven Co., Ltd., Tokyo, both of Japan

[21] Appl. No.: 09/458,084

[22] Filed: Dec. 10, 1999

[30] Foreign Application Priority Data

Oct. 21, 1999 [JP] Japan ..... 11-299840

[51] Int. Cl.[7] ..... A41B 1/00

[52] U.S. Cl. ..... 2/115; 2/DIG. 1

[58] Field of Search ..... 2/115, 69, 94, 2/DIG. 1, 113, 108

[56] References Cited

U.S. PATENT DOCUMENTS

| | | | |
|---|---|---|---|
| 3,045,243 | 7/1962 | Lash et al. | 2/115 |
| 4,120,053 | 10/1978 | Nemirofsky | 2/115 |
| 4,365,353 | 12/1982 | Rayl | 2/115 |
| 4,608,715 | 9/1986 | Miller et al. | 2/DIG. 1 |
| 4,813,081 | 3/1989 | Cliff et al. | 2/115 |
| 5,642,526 | 7/1997 | Thompson | 2/79 |
| 5,704,064 | 1/1998 | Van Der Sleesen | 2/DIG. 1 |
| 5,727,256 | 3/1998 | Rudman | 2/115 |

FOREIGN PATENT DOCUMENTS

| | | |
|---|---|---|
| 60-136326 | of 1985 | Japan . |
| 63-167123 | of 1988 | Japan . |

*Primary Examiner*—John J. Calvert
*Assistant Examiner*—Tejash Patel
*Attorney, Agent, or Firm*—Schlesinger, Arkwright & Garvey LLP

[57] ABSTRACT

Clothing, headgear, or sacks and bags made ventilative and/or decorative by means of a linear cut which is provided on surface thereof and which is open or closed selectively to expose a cover lined to the linear cut or to conceal the cover inside. When the cover is ventilative and exposed outside, the clothing and others become ventilative, while when the cover is drawn at its surface with patterns, pictures, or letters and exposed outside, the clothing and others become decorative.

5 Claims, 6 Drawing Sheets

VENTILATIVE AND/OR DECORATIVE CLOTHING, HEADGEAR, OR SACKS AND BAGS

BACKGROUND OF THE INVENTION:

This invention relates to clothing, headgear, or sacks which include knapsacks, rucksacks, and purses, and bags which include shopping bags, suitcases, Boston bags, and moneybags. It relates, more particularly, to the above-mentioned kind of goods having such unique openings which can make them ventilated, or by which patterns or design appearing on their surfaces can be changed or modified.

In order to make clothing, headgear, or sacks and bags ventilated, it has been widely known to make certain or entire parts of them netted.

And, in order to change patterns shown on clothing, several ideas have been proposed. For example, in Japanese Utility Model Preliminary Publication No. 60-136326, there is described clothes having such patterns which are drawn on seamy sides and which can be turned up so that they can be exposed outside. In Japanese Utility Model Preliminary Publication No. 63-167123, a cut-out of cloth decorated with patterns is detachably attached to clothing. It has been proposed also to print, on a shirt, patterns in a shape of necktie, or to selectively decorate buttons.

However, with respect to headgear, or sacks and bags, nothing has been proposed to change patterns decorated on them.

While it is known, as mentioned above, to have clothing, headgear, or sacks and bags ventilated by making their certain or whole parts by nets of desired meshes, their ventilative parts can not be closed even when the weather breaks. Patterns conventionally decorated on clothing, as described above, are immobile, and can not appear or disappear by themselves in situ.

In view of the above, it is one of the objects of this invention to provide clothing, headgear, or sacks and bags, into which air can be introduced or shut off by a simple manipulation of a device provided to them, and/or on which patterns can be appeared, disappeared, or changed by a simple manipulation of said device.

SUMMARY OF THE INVENTION

Clothing, headgear, or sacks and bags made in accordance with this invention, have an opening which is formed by a linear cut held open, is closable by a fastening means, and is lined with a material so as to be closed ventilatively. The material which closes the opening and which is either ventilative or stuffy, may additionally or alternatively be decorated on its outer surface with patterns, so that they can be seen through the opening.

Such patterns could be a part of larger patterns or pictures which are illustrated on a surface of the above-mentioned kind of goods, surrounding the opening. Fasteners which are commonly called as zippers, could preferably be employed as the aforementioned fastening means which close the opening.

In the clothing and so on made in accordance with this invention and having the above-mentioned constructions, the opening can be held open or closed readily by the manipulation of the fastening means. When it is open, they can be more ventilative, since air easily passes through the lining which is more ventilative than their surface materials, and when it is closed, the air is shut off. In another embodiment of this invention, when the opening is kept open, patterns on the lining appear through the opening, while when it is closed, the patterns disappear, whereby appearance or disappearance of the patterns is readily selective. In case that the patterns on the lining are made as a part of larger scope of patterns on the surface materials, the larger scope of patterns may be shown in two different ways, when the opening is open and when it is closed.

THE DRAWINGS

FIG. 1 is a front view of an embodiment of clothing made in accordance with this invention, FIG. 2 is a front view of another embodiment of clothing made in accordance with this invention, FIG. 3 is a side sectional view of FIG. 2, FIG. 4 is a side sectional view similar to FIG. 3, in which an opening is closed, FIG. 5 is a front view of still another embodiment of clothing made in accordance with this invention, FIG. 6 is a perspective view of an embodiment of headgear made in accordance with this invention, FIG. 7 is a perspective view of another embodiment of headgear made in accordance with this invention, FIG. 8 is a front view of a part of still another embodiment of headgear made in accordance with this invention, FIG. 9 is a perspective view of an embodiment of sacks and bags made in accordance with this invention, FIG. 10 is a perspective view of another embodiment of sacks and bags made in accordance with this invention, and FIG. 11 is a front view of a part of still another embodiment of sacks and bags made in accordance with this invention.

DETAILED DESCRIPTION OF TEH PREFERRED EMBODIMENTS

Certain preferred embodiments of this invention are explained below, more in detail, and with reference to the accompanying drawings, in which identical or correspondent parts of clothing and so on are indicated by same numerals.

Figure 1:
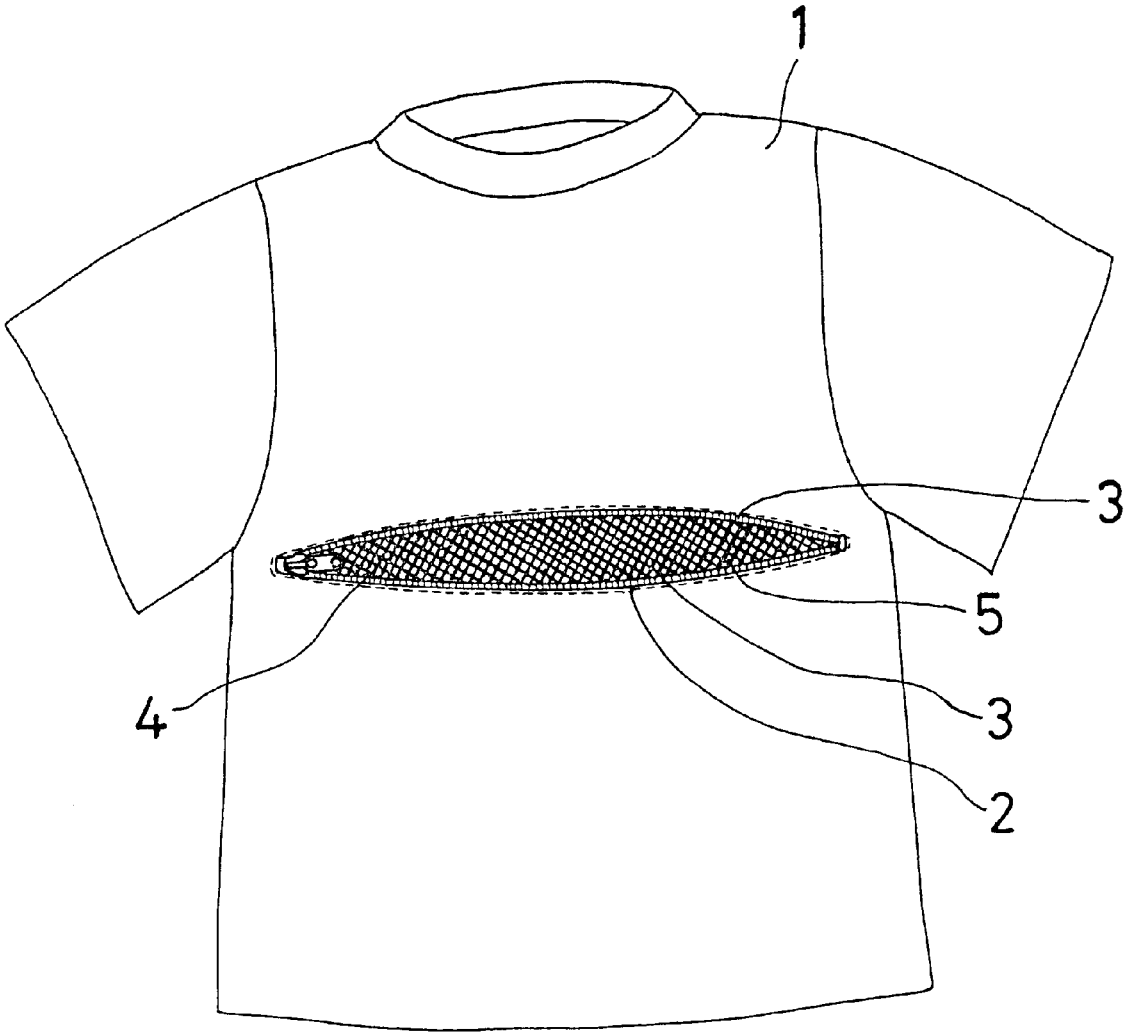
Figure 2:
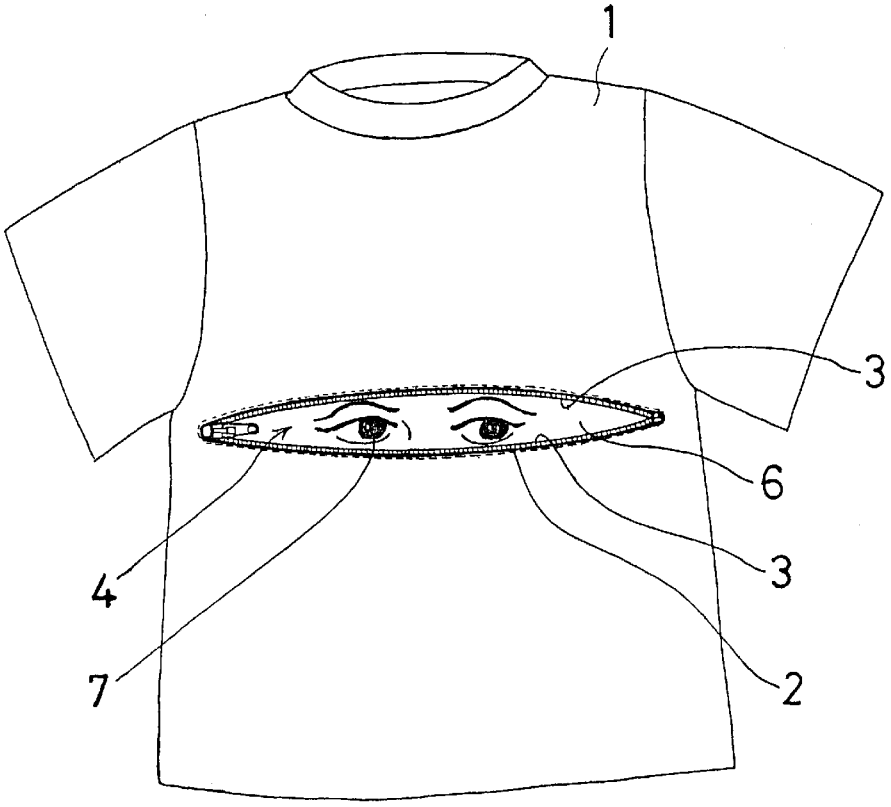
Figure 3:
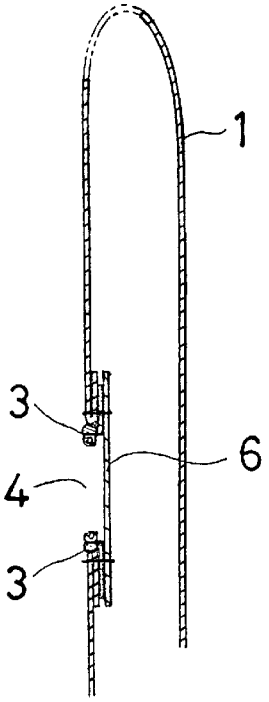
Figure 4:
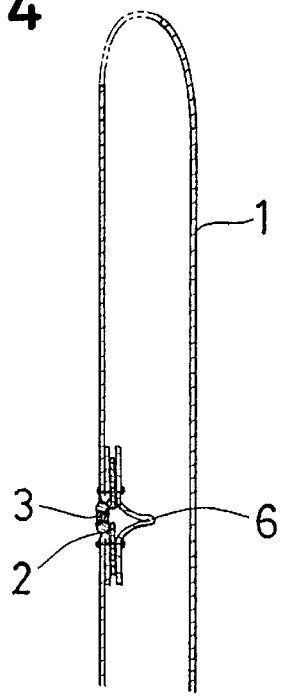

In FIGS. 1 and 2, by which two embodiments of clothing made in accordance with this invention are illustrated, on a surface part of the clothing 1, there is provided a linear cut 2 which is made open to form an ellipsoidal opening 4. To opposite two edges of the linear cut 2, there are stitched fasteners or zippers 3, by the manipulation of which the opening 4 may be closed or held open. In FIG. 1, the opening 4 is covered by a material 5 which is more ventilative than a surface material of the clothing and stitched to a back side of the clothing. Netted materials may advantageously be employed as the covering material 5. When the opening 4 is kept open, the netted covering material appears outside, and air flows into the clothing, while when it is closed, air is shut off. In the clothing 1 illustrated in FIG. 2, the opening 4 is lined with a cover 6, material of which may be same to the covering material 5 or may be stuffy. On this cover 6, there are printed patterns or pictures 7 which are exposed outside when the opening 4 is held open as shown in FIG. 3, and disappear when the opening is closed as shown in FIG. 4.

Figure 5:
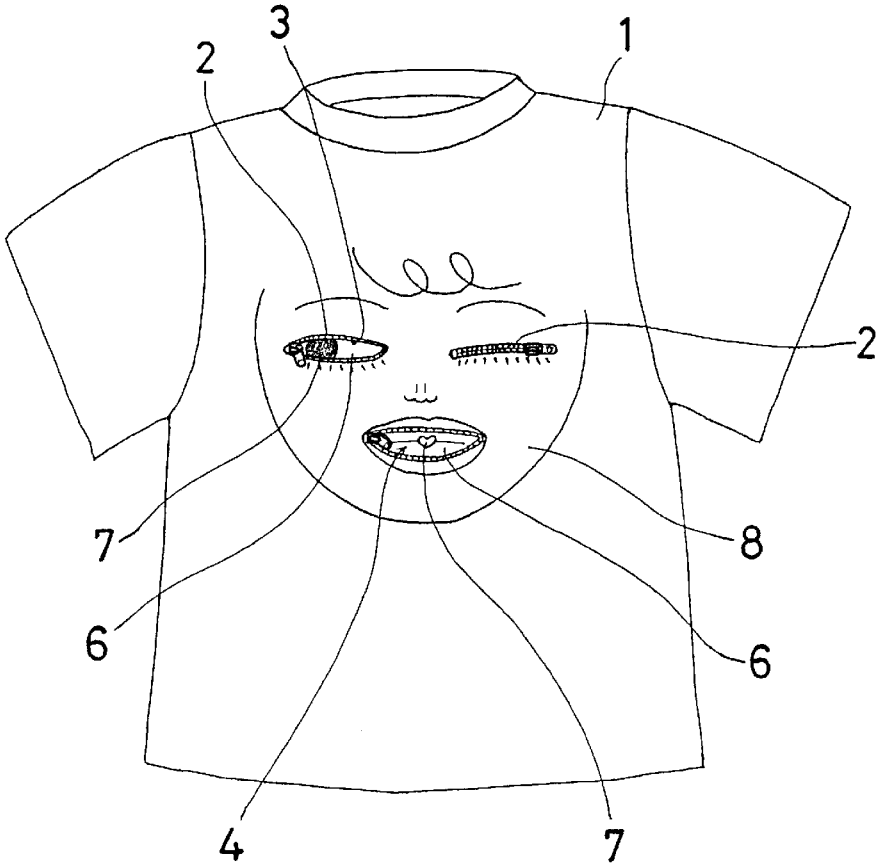

In FIG. 5, three linear cuts 2 are located at positions corresponding to eyes and a mouth of such face 8 which is drawn on the surface of the clothing 1 as a whole or larger scope of patterns or pictures. Eyeballs or teeth are drawn on the covers 6. When the openings 4 are closed, the eyes and mouth are closed, and when the openings are kept open, the eyes and mouth open. Thus, different looks can be expressed by selectively opening or closing the cuts 2.

Zippers 3 may be replaced by other fastening devices such as snap-fasteners, hooks and the like. While the linear cuts 2 extend horizontally in the embodiments shown in the drawings, they may extend vertically or they may be slanted. A desired number of cuts may be provided . It is a matter of course that the covers 5 or 6 can be attached to the back side of opening 4 by stitching, bonding, fusing, and so on.

Any pattern, picture, letter, and so on can be drawn on the cover 5 or 6 of the opening 4. When they are parts of larger images or figures such as the eyes and mouth of the face as illustrated in FIG. 5, they could be, for example, windows, doors, and the like, by the opening of which inner sights can be observed.

Figure 6:
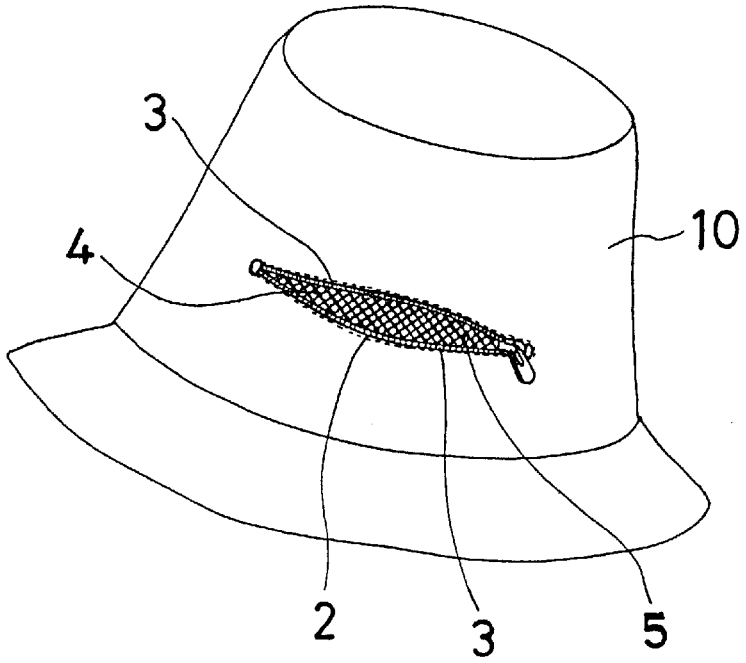
Figure 7:
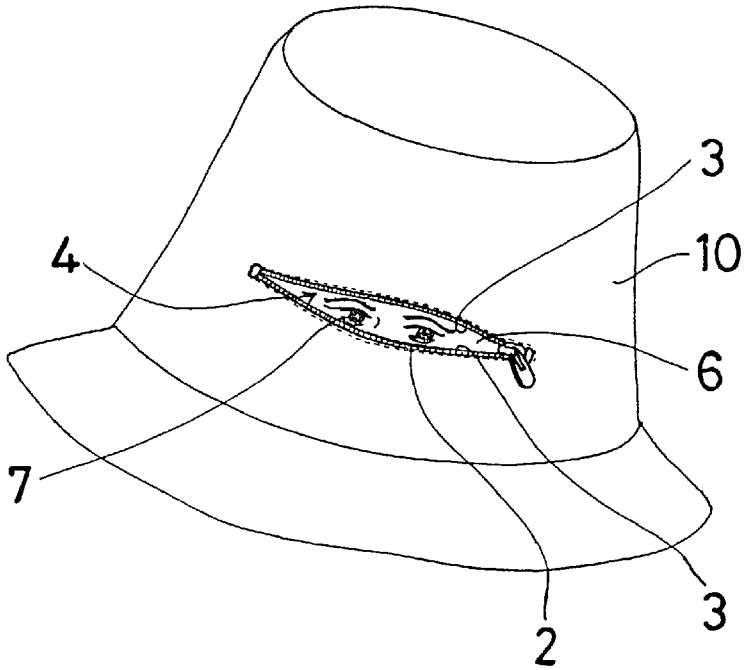
Figure 8:
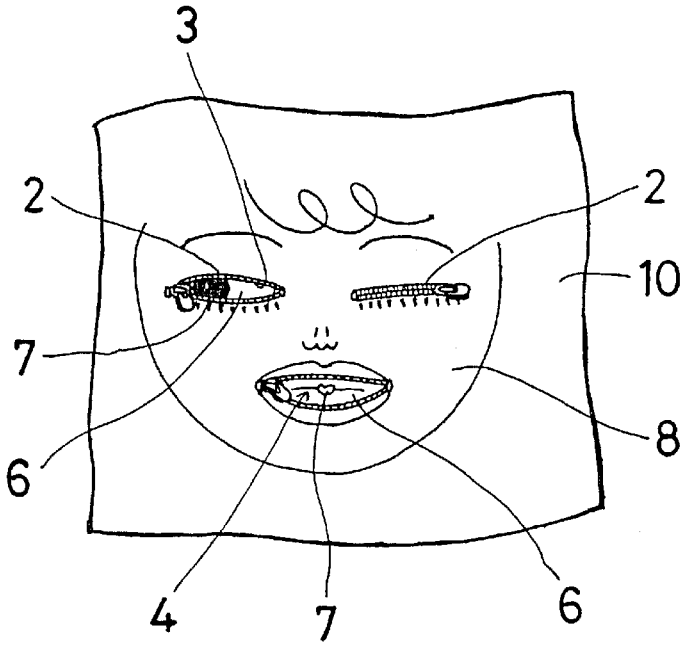
Figure 9:
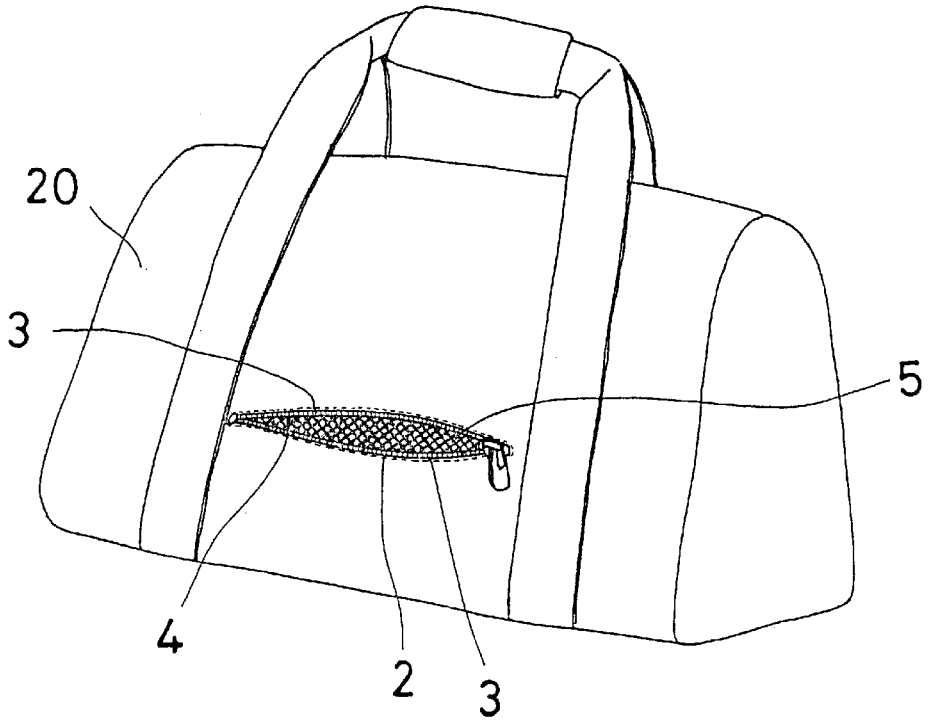
Figure 10:
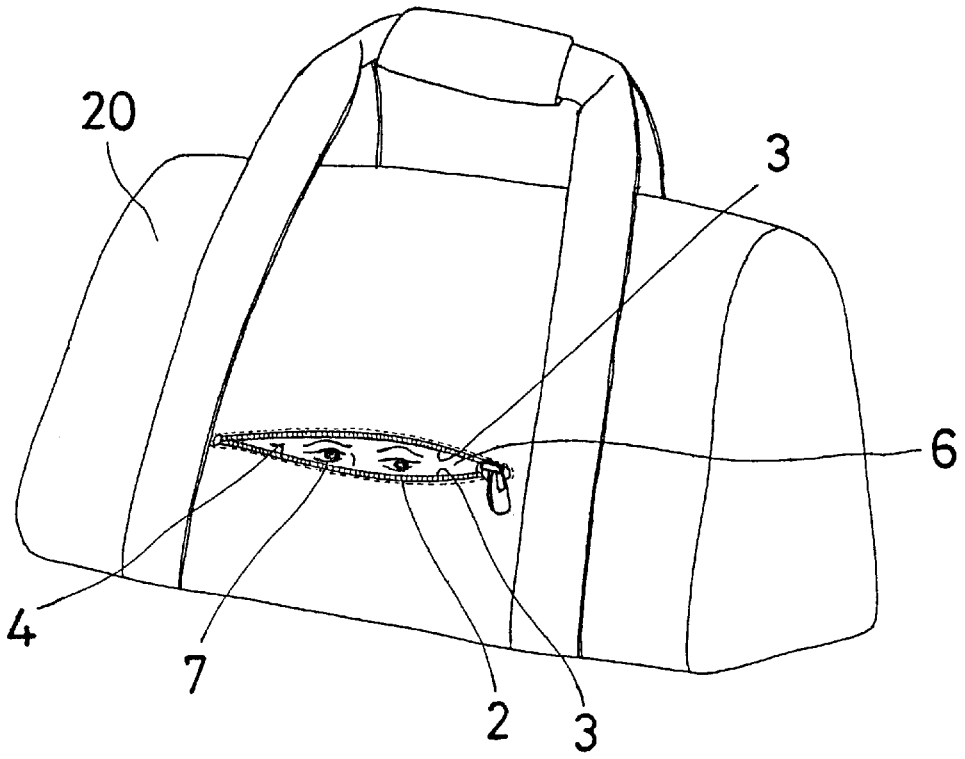
Figure 11:
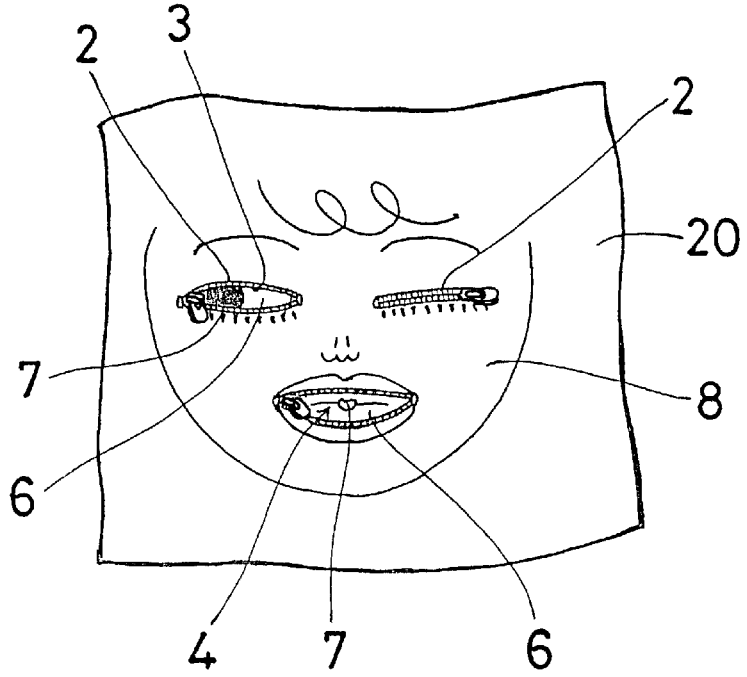

In FIG. 6, a hat 10 is provided with a linear cut 2 which forms an opening 4, while in FIG. 9, a bag is likewise provided with a linear cut 2 which forms an opening 4. The openings are covered by nets 5 so as to make the hat and bag ventilated. In case of said hat and the bag illustrated in FIGS. 7 and 10, the openings 4 are closed by covers 6 with patterns 7. And, in FIGS. 8 and 11, the patterns 7 constitute parts of larger FIGS. 8.

As described above, by a simple manipulation of fastening means provided to clothing, headgear, or sacks and bags in accordance with this invention, they can be ventilative when so desired. They can be uniquely decorative too.

What is claimed is:

1. Clothing, headgear, sack or bag, comprising:

a) a surface including a plurality of linear cuts that form openings lined with respective back covers, said openings including respective fasteners to selectively open or close said openings to expose said back covers;

b) said back covers including front surfaces having respective patterns comprising eyes and mouth; and c) said patterns forming an overall pattern of a face wherein the appearance of the overall pattern is changeable by selectively closing or opening some of said openings.

2. Clothing, headgear, sack or bag as in claim 1, wherein said fasteners include zippers.

3. Clothing, headgear, sack or bag as in claim 1, wherein said fasteners include snap fasteners.

4. Clothing, headgear, sack or bag as in claim 1, wherein said back covers are ventilative.

5. Clothing, headgear, sack or bag as in claim 1, wherein said overall pattern is a human face.

* * * * *